US008025197B2

(12) United States Patent
Brendel et al.

(10) Patent No.: US 8,025,197 B2
(45) **Date of Patent: *Sep. 27, 2011**

(54) PROFILE LIFTER FOR A NAILER

(75) Inventors: Lee M. Brendel, Bel Air, MD (US); James J. Kenney, Baltimore, MD (US); Paul G. Gross, White Marsh, MD (US); Jan Carl Denner, Hampstead, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/407,014

(22) Filed: Mar. 19, 2009

(65) Prior Publication Data

US 2009/0173765 A1 Jul. 9, 2009

Related U.S. Application Data

(63) Continuation of application No. 11/760,982, filed on Jun. 11, 2007, now Pat. No. 7,556,184.

(51) Int. Cl.
*B27F 7/00* (2006.01)

(52) U.S. Cl. ..... 227/8; 227/120

(58) Field of Classification Search ..... 227/8, 133, 227/131, 132, 134

See application file for complete search history.

(56) References Cited

U.S. PATENT DOCUMENTS 4,121,745 A * 10/1978 Smith et al. ..... 227/8
4,129,240 A * 12/1978 Geist ..... 227/8
4,298,072 A * 11/1981 Baker et al. ..... 173/13
4,323,127 A * 4/1982 Cunningham ..... 173/53
4,721,170 A * 1/1988 Rees ..... 173/13
4,964,558 A * 10/1990 Crutcher et al. ..... 227/8
5,511,715 A * 4/1996 Crutcher et al. ..... 227/131
6,796,475 B2 * 9/2004 Adams ..... 227/2
7,204,403 B2 * 4/2007 Kenney et al. ..... 227/133
7,331,403 B2 * 2/2008 Berry et al. ..... 173/1
2002/0108993 A1 * 8/2002 Harper et al. ..... 227/51
2002/0108994 A1 * 8/2002 Burke et al. ..... 227/81
2005/0217873 A1 * 10/2005 Gross et al. ..... 173/1
2005/0217875 A1 * 10/2005 Forster et al. ..... 173/1
2005/0218174 A1 * 10/2005 Kenney et al. ..... 227/2
2005/0218178 A1 * 10/2005 Berry et al. ..... 227/8
2005/0218182 A1 * 10/2005 Berry et al. ..... 227/131
2005/0218184 A1 * 10/2005 Buck et al. ..... 227/131
2005/0218185 A1 * 10/2005 Kenney et al. ..... 227/133
2005/0218186 A1 * 10/2005 Forster ..... 227/133
2005/0224552 A1 * 10/2005 Berry et al. ..... 227/131
2007/0102471 A1 * 5/2007 Gross et al. ..... 227/131

* cited by examiner

*Primary Examiner* — Brian D Nash
(74) *Attorney, Agent, or Firm* — Rhonda L. Barton; Scott B. Markow; Adan Ayala

(57) ABSTRACT

A driving tool that includes a frame, a motor assembly and a resilient member. The motor assembly is coupled to the frame and includes an electric motor, a flywheel driven by the electric motor, a pinch roller and a driver disposed between the flywheel and the pinch roller. The pinch roller is selectively movable from a first position to a second position to drive the driver into engagement with the flywheel. The driver is movable between a returned position and an extended position. The resilient member is coupled to the frame and biases the driver away from the flywheel to reduce or eliminate contact between the flywheel and the driver when the flywheel is at rest, the driver is in the returned position and the pinch roller is in the first position. A method for operating a driving tool is also provided.

7 Claims, 6 Drawing Sheets

PROFILE LIFTER FOR A NAILER

CROSS REFERENCE TO RELATED APPLICATIONS

The present application is a continuation of U.S. patent application Ser. No. 11/760,982, filed Jun. 11, 2007, and entitled "Profile Lifter For A Nailer". The above-mentioned patent application is herein incorporated by reference in its entirety.

INTRODUCTION

The present invention generally relates to driving tools, such as nailers. More particularly to a driving tool having a driver that is selectively translated by a rotating flywheel and a method for operating a driving tool.

Copending U.S. patent application Ser. No. 11/095,696 discloses a driving tool having a driver that is selectively translated by a rotating flywheel. A pair of resilient return cords bias the driver into a returned position relative to a structural backbone or frame. The upper bumper assembly is configured to abut a contoured end face of the driver; the shapes of the contoured end face and an abutting surface of the upper bumper assembly cooperate to impede movement of the end of the driver associated with the contoured end face in a direction toward the flywheel.

SUMMARY

In one form, the present teachings provide a driving tool that includes a frame, a motor assembly and a resilient member. The motor assembly is coupled to the frame and includes an electric motor, a flywheel driven by the electric motor, a pinch roller and a driver disposed between the flywheel and the pinch roller. The pinch roller is selectively movable from a first position to a second position to drive the driver into engagement with the flywheel. The driver is movable between a returned position and an extended position. The resilient member is coupled to the frame and biases the driver away from the flywheel to reduce or eliminate contact between the flywheel and the driver when the flywheel is at rest, the driver is in the returned position and the pinch roller is in the first position.

In another form, the present teachings provide a method of operating a driver. The method can include: providing a driver that includes a frame and a motor assembly, the motor assembly being coupled to the frame and including an electric motor, a flywheel driven by the electric motor, a pinch roller and a driver disposed between the flywheel and the pinch roller, the pinch roller being selectively movable from a first position to a second position to drive the driver into engagement with the flywheel, the driver being movable between a returned position and an extended position; and supporting the driver on opposite lateral side of the flywheel when the flywheel is at rest, the driver is in the returned position and the pinch roller is in the first position.

In yet another form, the present teachings provide a driving tool that includes a frame, a motor assembly and a support. The motor assembly is coupled to the frame and includes a flywheel and a driver. The flywheel is rotatable about a rotational axis. The driver is selectively translated by the flywheel from a returned position to an extended position. The support is coupled to the frame and includes at least one movable portion that contacts the driver when the driver is in the returned position and the flywheel is at rest, the at least one movable portion urging the driver in a direction away from the flywheel.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION OF THE VARIOUS EMBODIMENTS

Figure 1:
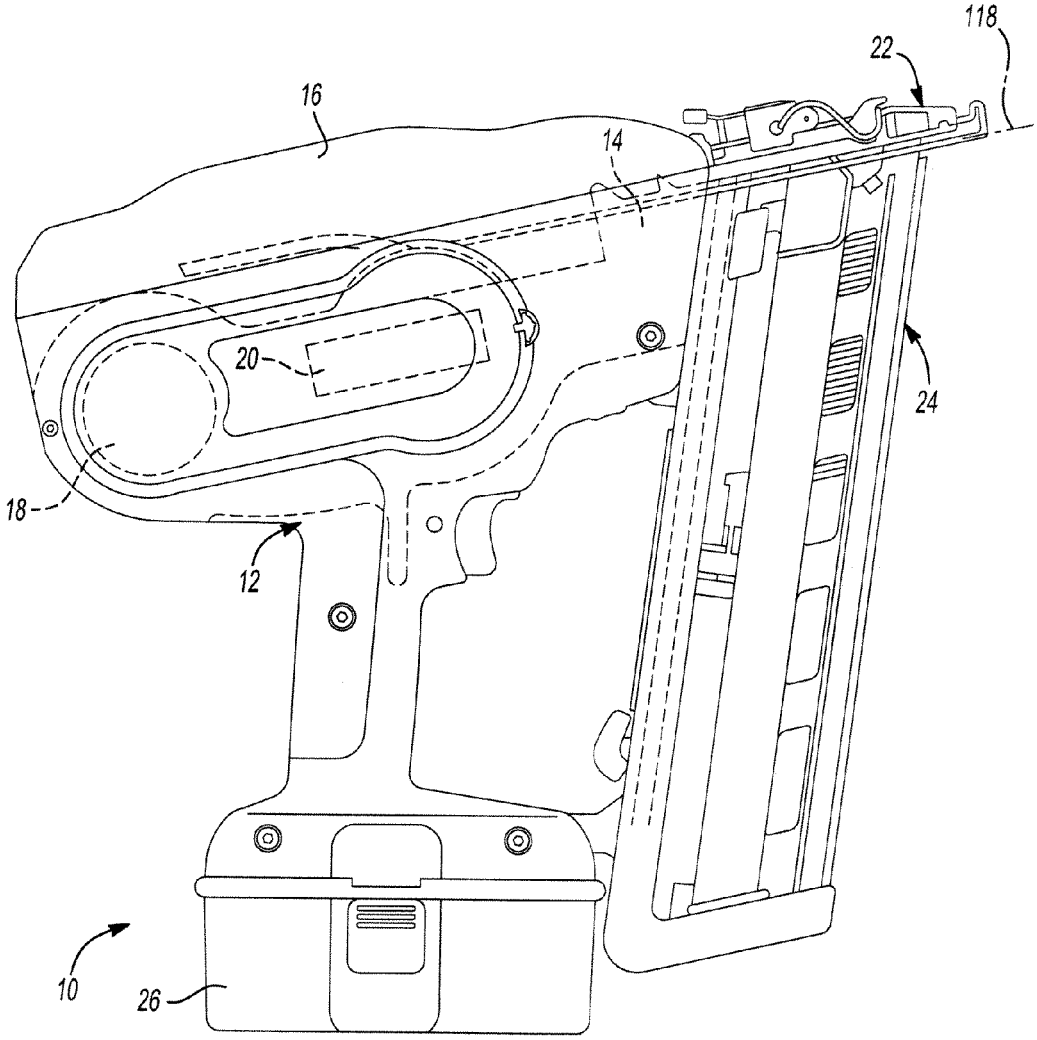
FIG. 1 is a side elevation view of a driving tool constructed in accordance with the teachings of the present disclosure.
Figure 5:
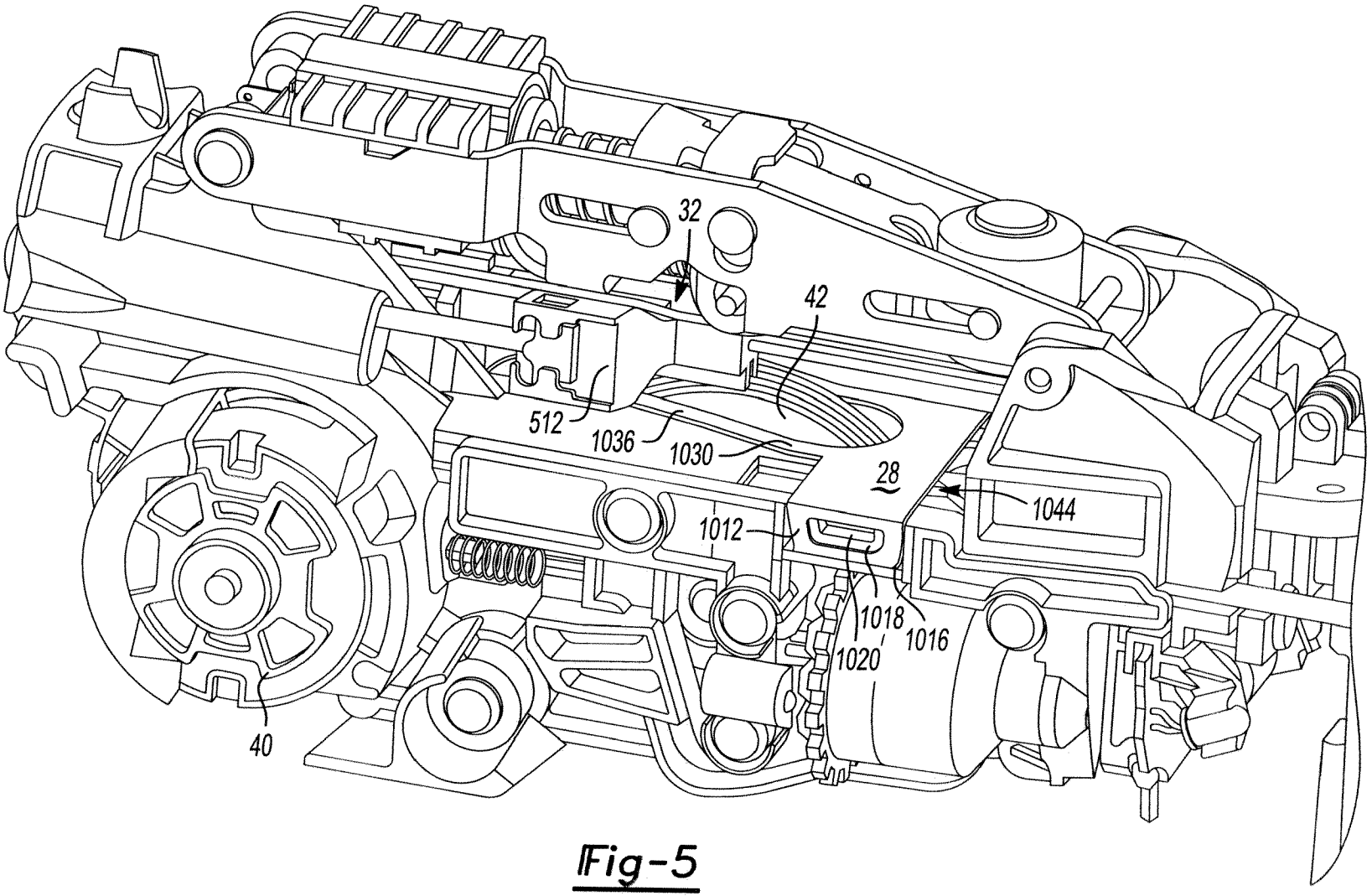
FIG. 5 is a perspective view of the frame, the motor assembly and the support.

With reference to FIG. 1 of the drawings, a driving tool constructed in accordance with the teachings of the present invention is generally indicated by reference numeral 10. The fastening tool 10 can include a housing assembly 12, a backbone or frame 14, a backbone cover 16, a drive motor assembly 18, a control unit 20, a nosepiece assembly 22, a magazine assembly 24, a battery pack 26 and a support 28 (FIG. 5). While the fastening tool 10 is illustrated as being electrically powered by a suitable power source, such as the battery pack 26, those skilled in the art will appreciate that the invention, in its broader aspects, may be constructed somewhat differently and that aspects of the present invention may have applicability to pneumatically powered fastening tools. Furthermore, while aspects of the present invention are described herein and illustrated in the accompanying drawings in the context of a nailer, those of ordinary skill in the art will appreciate that the invention, in its broadest aspects, has further applicability. For example, the drive motor assembly 18 may also be employed in various other mechanisms that utilize reciprocating motion, including rotary hammers, hole forming tools, such as punches, and riveting tools, such as those that install deformation rivets.

Except as otherwise described herein, the housing assembly 12, the frame 14, the backbone cover 16, the drive motor assembly 18, the control unit 20, the nosepiece assembly 22, the magazine assembly 24 and the battery pack 26 can be constructed in a manner which is described in U.S. patent application Ser. No. 11/095,723 entitled "Method For Controlling A Power Driver" and U.S. patent application Ser. No. 11/095,696 entitled "Activation Arm Configuration For A Power Tool", the disclosures of which are hereby incorporated by reference as if fully set forth in detail herein, Briefly, the housing 12 can shroud all or portions of the frame 14, the drive motor assembly 18 and the control unit 20. The frame 14 can serve as a structure or foundation to which the backbone cover 16, the drive motor assembly 18 the control unit 20 and the nosepiece assembly 22 can be coupled.

Figure 2:
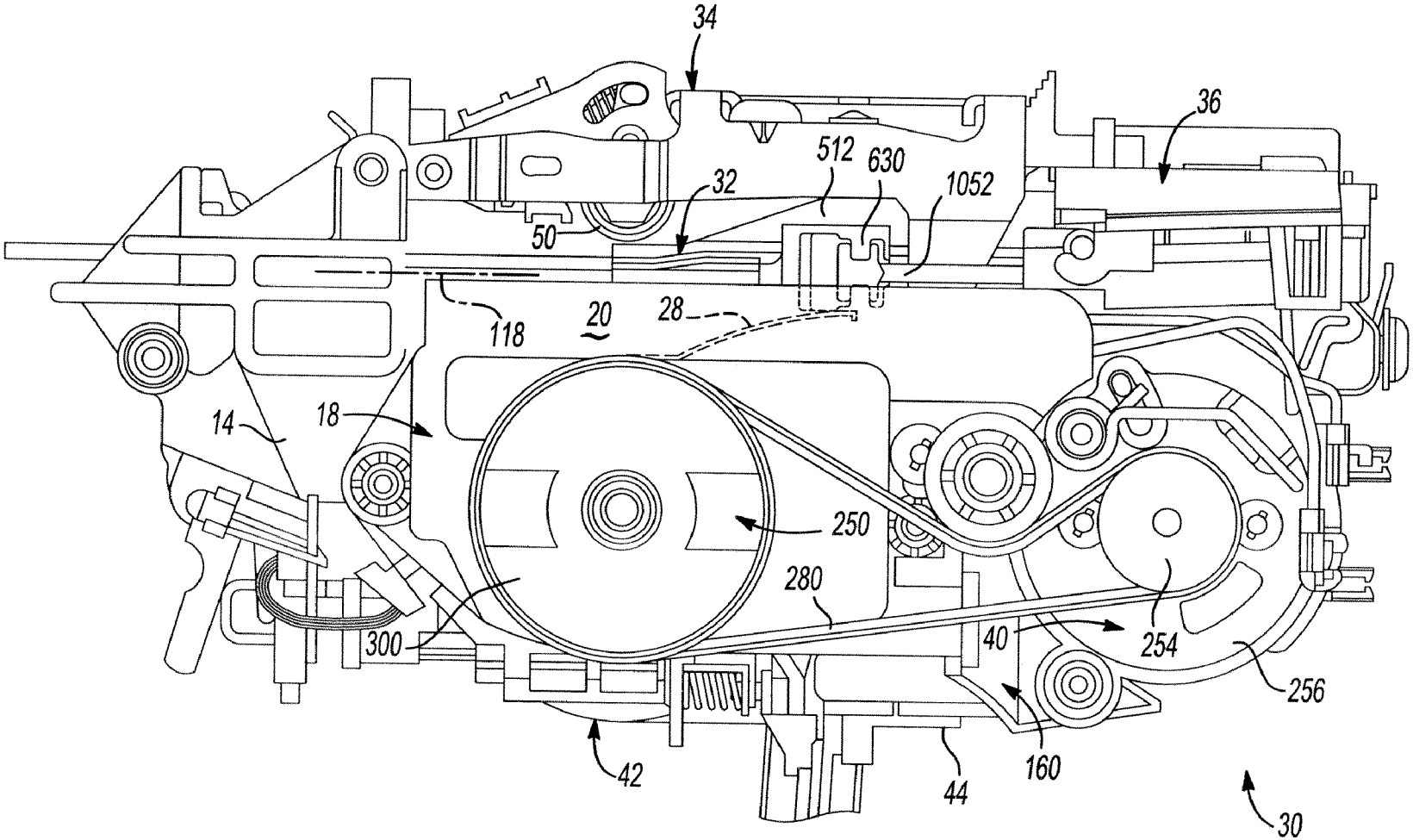
FIGS. 2 and 3 are left and right side elevation views, respectively, of a portion of the driving tool of FIG. 1, illustrating the frame, the motor assembly and the support in more detail.
Figure 3:
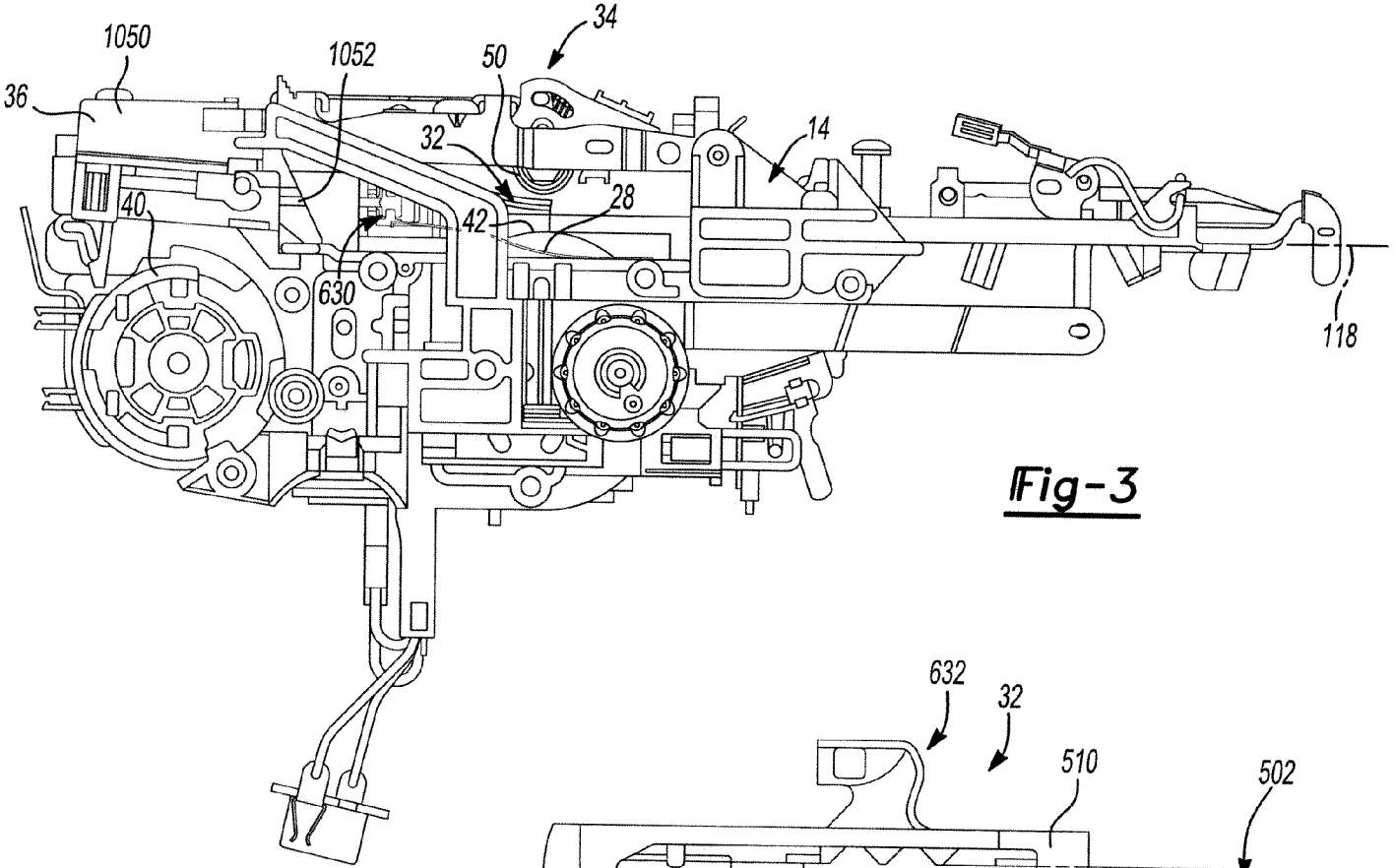

With reference to FIGS. 2 and 3, the drive motor assembly 18 can include a power source 30, a driver 32, a follower assembly 34, which can include a follower 50, such as a roller, and a return mechanism 36. The power source 30 can include a motor 40, a flywheel 42 and an actuator 44. The flywheel 42 can be driven by the motor 40 for example via a motor pulley 254, which can be coupled for rotation with an output member of the motor 40, a flywheel pulley 300, which can be rotatably coupled to the flywheel 42, and a belt 280 that can transmit rotary power from the motor pulley 254 to the flywheel pulley 300. The actuator 44 can be employed to move the follower assembly 34 to drive the roller 50 toward the flywheel 42.

Figure 4:
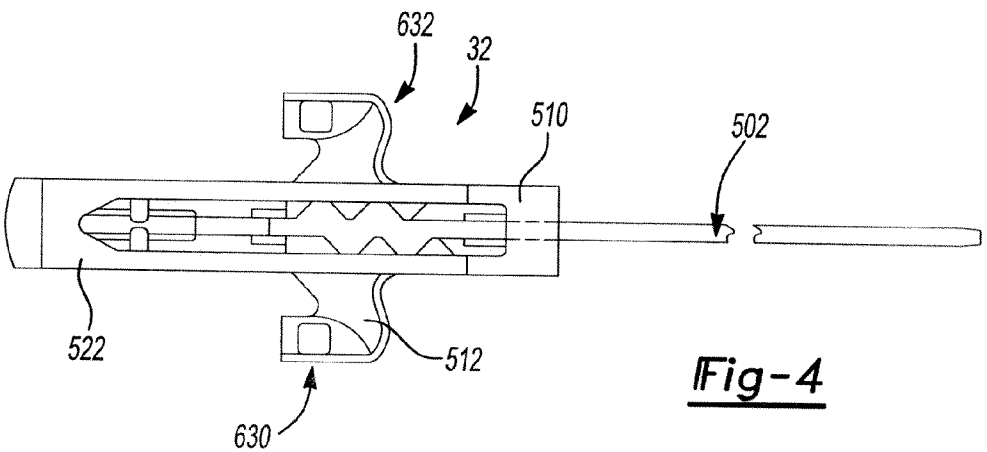
FIG. 4 is a top plan view of a portion of the motor assembly illustrating the driver in more detail.
Figure 7:
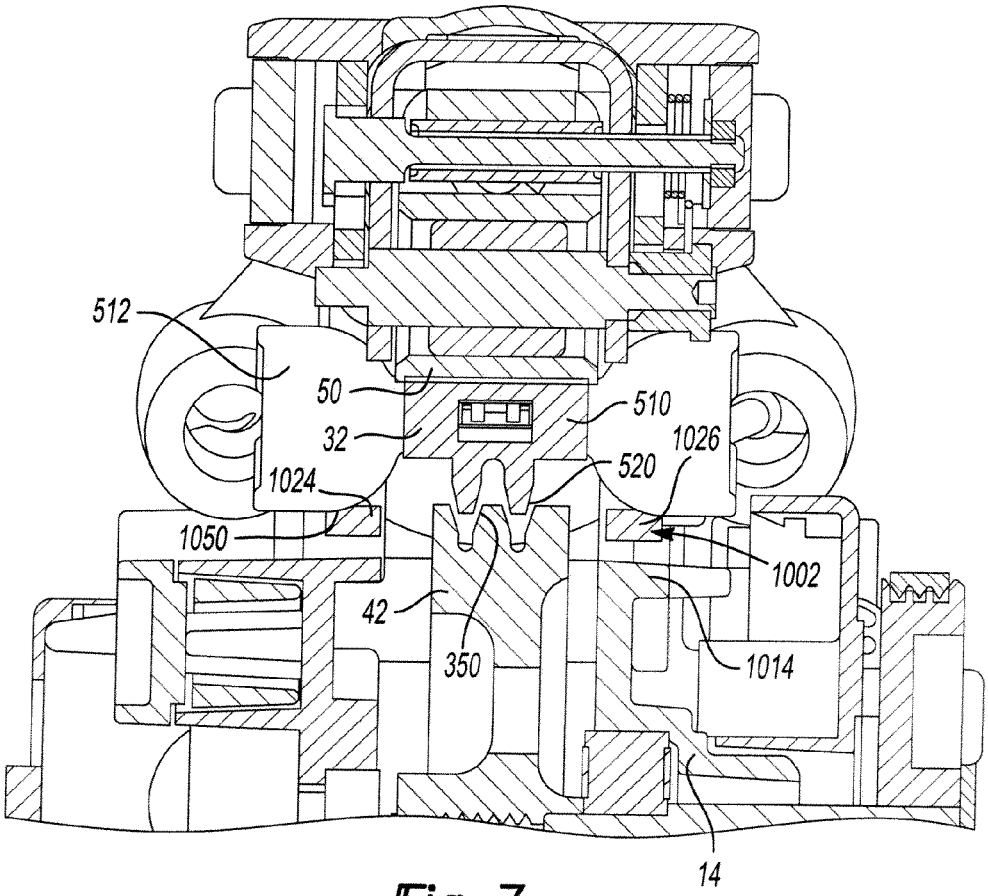
FIG. 7 is a lateral section view of a portion of the driving tool of FIG. 1 taken through the rotational axis of the flywheel.

With additional reference to FIG. 4, the driver 32 can be disposed between the flywheel 42 and the roller 50 and can include an upper driver member 500 and a driver blade 502. The upper driver member 500 can include a body 510 and a pair of projections 512 that extend from the opposite lateral sides of the body 510. The body 510 may include a driver profile 520 (FIG. 7), which is configured to engage the exterior surface 350 of the flywheel 42, and a cam profile 522 that is disposed on a side of the body 510 opposite the driver profile 520 (FIG. 7). The projections 512 can be employed both as return anchors 630, i.e., points at which the driver 32 is coupled to the return mechanism 36 (FIG. 2), and as bumper tabs 632 that are used to stop downward movement of the driver 32 after a fastener has been installed to a workpiece.

Returning to FIGS. 2 and 3, the return mechanism 36 can include a housing 1050, which can be coupled to the frame 14, and a pair of return cords 1052 that can be engaged to the housing 1050 and the projections 512. The return cords 1052 can be resilient to permit the driver 32 to translate between a returned position and an extended position along a translation axis 118; the return cords 1052 can bias the driver 32 toward the returned position.

Figure 6:
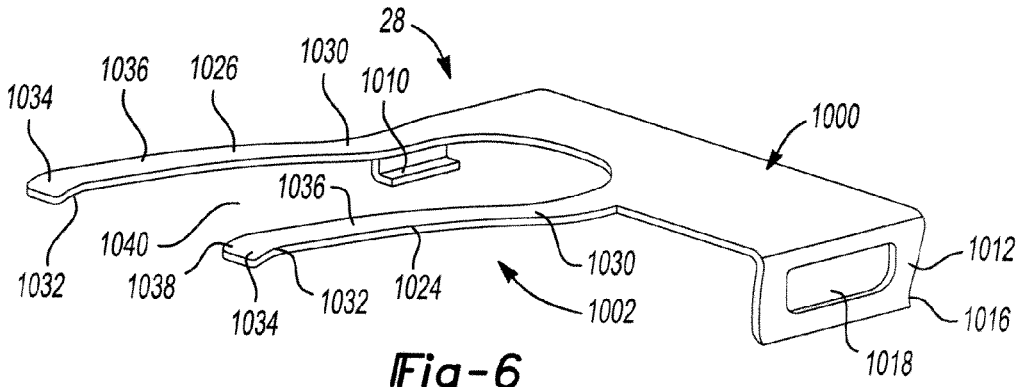
FIG. 6 is a perspective view of the support.

With reference to FIGS. 5 and 6, the support 28 can include a body portion 1000 and a support portion 1002. In the particular embodiment provided, the body portion 1000 and the support portion 1002 are unitarily formed of spring steel. The body portion can be coupled or secured to the frame 14 in any desired manner, such as threaded fasteners (not shown). The body portion 1000 can include a span member 1008 that can span the width of the frame 14 at a location forwardly of the flywheel 42 as well as first and second clip structures 1010 and 1012, respectively, that can be removably coupled to the opposite lateral sides of the frame 14. The first clip structure 1010 can be coupled to a first side of the span member 1008 and can be a generally C-shaped bracket configured to engage a rail 1014 (FIG. 7) formed on a first lateral side of the frame 14. The second clip structure 1012 can include a tab 1016 that can be resiliently coupled to a second, opposite side of the span member 1008. The tab 1016 can include an opening 1018 that can receive a projection 1020 formed on the frame 14 when the body portion 1000 is engaged to the frame 14. In this regard, the first clip structure 1010 can be aligned to the rail 1014 (FIG. 7) and the body portion 1000 can be rotated about the rail 1014 (FIG. 7) to cause the tab 1016 to slip over the projection 1020 to align the opening 1018 to the projection 1020. The resilient configuration of the tab 1016 secures the body portion 1000 to the frame 14, while the opening 1018 and the first clip structure 1010 cooperate with the projection 1020 and the rail 1014 (FIG. 7), respectively, to prevent the body portion 1000 from slipping off the frame 14.

The support portion 1002 can be coupled to the body portion 1000 and can be configured in any desired manner to support the body 510 of the driver 32 in an area proximate a location at which the driver 32 and the flywheel 42 contact one another when energy is transmitted from the flywheel 42 to the driver 32 to propel the driver 32 along the translation axis 118 (FIG. 3). For example, the support portion 1002 can comprise first and second arms 1024 and 1026, respectively, that are disposed on opposite lateral sides of the flywheel 42.

The first and second arms 1024 and 1026 are similarly configured in the example provided and as such, a discussion of the first arm 1024 will suffice for both. It will be appreciated that elements of the second arm 1026 will be designated by the reference numerals used in the discussion of corresponding elements of the first arm 1024.

The first arm 1024 can include a proximal end 1030, which can be coupled to the body portion 1000, and a support member 1032 that can be configured to engage a lower surface of the driver 32, such as a lower surface of the projections 512. In the particular example provided, the support member 1032 is formed on a distal, unsupported cantilevered end 1034 of the first arm 1024 and an intermediate portion 1036 of the first arm 1024, which extends upwardly and away from the body portion 1000 with increasing distance away from the body portion 1000, couples the proximal and distal ends 1030 and 1034 to one another. The distal end 1034 can have an arcuate upper surface 1038 that can curve downwardly. It will be appreciated that the support member 1032 could be configured otherwise, however, e.g., supported on two sides, and that the support member 1032 need only be movable away from the driver 32 and toward the frame 14 when the tool 10 is to be actuated. The first and second arms 1024 and 1026 can be disposed on opposite lateral sides of the flywheel and cooperate to define a generally U-shaped aperture 1040 that permits the support 28 to fit about the flywheel 42 on a side of the flywheel 42 opposite the motor 40.

Figure 8:
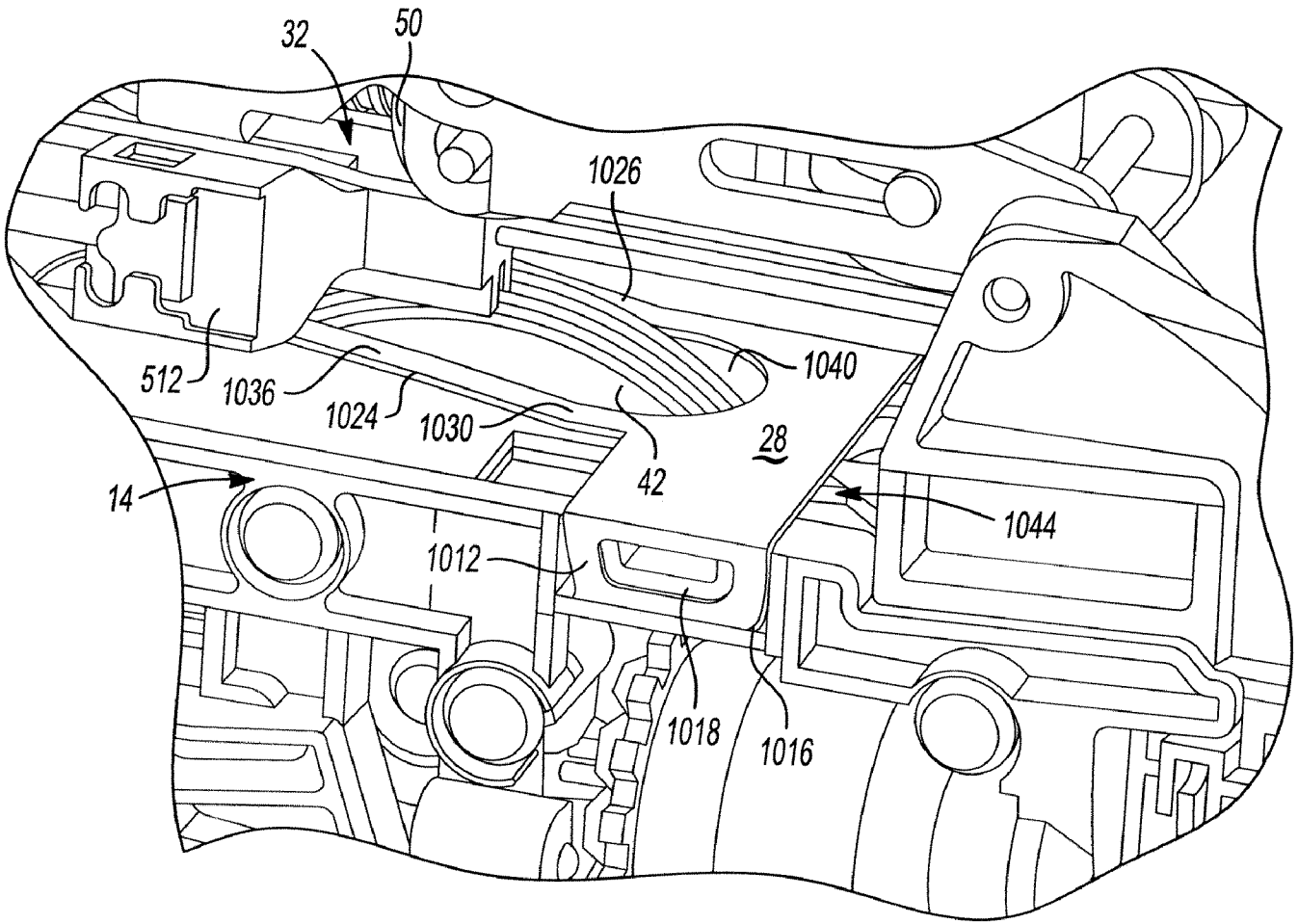
FIG. 8 is an enlarged portion of FIG. 5.

With reference to FIGS. 7 and 8, the body portion 1000 can cover a space 1044 between the flywheel 42 and the frame 14. The support portion 1002 can contact an underside 1050 of the driver (e.g., at the projections 512) and can urge the driver 32 away from the exterior surface 350 of the flywheel 42 when the flywheel 42 is at rest, the driver 32 is in the returned position and the follower 50 is in the first position (shown in FIG. 7). In the particular example illustrated, the support portion 1002 maintains the driver profile 520 in a condition spaced apart from the exterior surface 350 of the flywheel 42 when the flywheel 42 is at rest, the driver 32 is in the returned position and the follower 50 is in the first position.

The support 28 can reduce or eliminate contact between the driver 32 and the flywheel 42 when the tool 10 is in a deactuated condition. When the tool 10 is to be activated, the motor 40 (FIG. 2) can drive the flywheel 42 and the actuator 44 (FIG. 2) can move the follower assembly 34 to cause the follower 50 to urge the driver 32 downwardly into engagement with the rotating flywheel 42 to transfer energy from the flywheel 42 to the driver 32. As the first and second arms 1024 and 1026 are movable (e.g., resiliently movable in the example provided), they move downwardly toward the frame 14 with the driver 32 as the follower 50 pushes the driver 32 downwardly.

After actuation of the tool 10, the return cords 1052 will bias the driver 32 toward the returned position. The angled configuration of the intermediate portion 1036 of the first and second arms 1024 and 1026 can assist in guiding the driver (i.e., through contact with the driver 32) as the driver 32 travels to the returned position so as to reduce or eliminate contact between the flywheel 42 and the driver 32.

While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims.

What is claimed is:

1. A driving tool comprising:

a frame;

a motor assembly coupled to the frame, the motor assembly having a flywheel that is rotatable about a rotational axis and a driver that is selectively movable to frictionally engage a rotating perimeter of the flywheel so as to translate the driver from a returned position to an extended position, the driver having an underside facing the flywheel; and a support coupled to the frame, the support having at least one movable portion that contacts the underside of the driver when the driver is in the returned position and the flywheel is at rest, the at least one movable portion urging the driver in a direction away from the flywheel.

2. The driving tool of claim 1, wherein the support includes a support body and wherein the at least one movable portion of the support is resiliently coupled to the support body.

3. The driving tool of claim 2, wherein the support body is clipped to the frame.

4. The driving tool of claim 1, wherein the at least one movable portion includes a spring.

5. The driving tool of claim 4, wherein the spring is a leaf spring.

6. The driving tool of claim 1, wherein the support includes a first portion on a first lateral side of the flywheel and a second portion on a second lateral side of the flywheel.

7. The driving tool of claim 6, wherein the support is generally U-shaped.

* * * * *